US009150335B2

(12) United States Patent
Lane

(10) Patent No.: US 9,150,335 B2
(45) **Date of Patent: *Oct. 6, 2015**

(54) BEVERAGE CONTAINER SYSTEM WITH BUTTON RELEASE FOR LID

(71) Applicant: THERMOS L.L.C., Schaumburg, IL (US)

(72) Inventor: Marvin Lane, Wheeling, IL (US)

(73) Assignee: THERMOS L.L.C., Schaumburg, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/195,756

(22) Filed: Mar. 3, 2014

(65) Prior Publication Data

US 2014/0175098 A1 Jun. 26, 2014

Related U.S. Application Data

(63) Continuation-in-part of application No. 13/407,238, filed on Feb. 28, 2012, now Pat. No. 8,689,989.

(51) Int. Cl.
*B65D 51/04* (2006.01)
*A47G 19/22* (2006.01)
(Continued)

(52) U.S. Cl.
CPC . *B65D 43/26* (2013.01); *A45F 3/16* (2013.01); *A45F 3/18* (2013.01)

(58) Field of Classification Search
CPC ..... A45F 3/16; A45F 3/18; B65D 43/26; B65D 2251/0021; A47G 19/2272
USPC ..... 220/709, 254.5, 835, 834, 833, 262, 220/263, 264, 705, 715; 215/388, 305, 244, 215/245, 237; 222/556
See application file for complete search history.

(56) References Cited

U.S. PATENT DOCUMENTS 4,742,928 A 5/1988 Braun
5,199,597 A * 4/1993 Gladish ..... 220/715
(Continued)

FOREIGN PATENT DOCUMENTS

CN 1636835 A 7/2005
CN 201641706 U 11/2010
(Continued)

OTHER PUBLICATIONS

Gocontigo—Autospout Addison Water Bottle—24 oz.; Jul. 26, 2011.
(Continued)

*Primary Examiner* — Fenn Mathew
*Assistant Examiner* — James N Smalley
(74) *Attorney, Agent, or Firm* — Polsinelli PC

(57) ABSTRACT

A drink bottle with a removable lid includes an inner lid attached to the mouth of the bottle and an outer lid or cover pivotably mounted on the inner lid. The outer lid or cover may be locked into a closed position covering the drinking tube. A push button on the inner lid can be operated to release the locked outer lid, permitting the outer lid to open so as to permit drinking from a drinking tube positioned therein. The push button moves a lid slide that extends to a point on the inner lid generally opposite to the hinge and contains an extension that engages with a notch in the upper lid to hold the upper lid closed. On actuating the push button, the lid slide is pulled in the direction of the push button and the extension located on the other end of the lid slide moves out of engagement of the outer lid, thereby opening the outer lid.

20 Claims, 6 Drawing Sheets

(51) Int. Cl.

| | |
|---|---|
| ***B65D 43/26*** | (2006.01) |
| ***A45F 3/16*** | (2006.01) |
| ***A45F 3/18*** | (2006.01) |

(56) References Cited

U.S. PATENT DOCUMENTS

| | | | |
|---|---|---|---|
| 5,203,468 | A | 4/1993 | Hsu |
| 5,244,113 | A | 9/1993 | Stymiest |
| 5,282,541 | A | 2/1994 | Chen |
| 6,279,773 | B1 | 8/2001 | Kiyota |
| D455,611 | S | 4/2002 | Kitamura et al. |
| D529,339 | S | 10/2006 | Carreno et al. |
| D538,110 | S | 3/2007 | Kitamura et al. |
| D547,607 | S | 7/2007 | Forsman |
| D555,000 | S | 11/2007 | Bunce et al. |
| D586,184 | S | 2/2009 | Miller et al. |
| D587,969 | S | 3/2009 | Gilbert |
| D588,411 | S | 3/2009 | Watanabe |
| D590,661 | S | 4/2009 | Kitamura et al. |
| D592,012 | S | 5/2009 | Carreno |
| D596,460 | S | 7/2009 | Nezu |
| D608,640 | S | 1/2010 | Carreno |
| D609,964 | S | 2/2010 | Lane |
| D610,402 | S | 2/2010 | Carreno |
| D614,961 | S | 5/2010 | Thomas et al. |
| D615,412 | S | 5/2010 | Thomas et al. |
| 7,766,057 | B2 | 8/2010 | Windmiller |
| D623,473 | S | 9/2010 | Chen |
| D652,256 | S | 1/2012 | Eyal |
| D653,082 | S | 1/2012 | George |
| D656,360 | S | 3/2012 | Miller et al. |
| D656,787 | S | 4/2012 | Phillips et al. |
| D658,072 | S | 4/2012 | Davis et al. |
| D663,209 | S | 7/2012 | Maas et al. |
| D667,268 | S | 9/2012 | Pallotto |
| D667,269 | S | 9/2012 | Pallotto |
| D675,873 | S | 2/2013 | Miller et al. |
| D676,278 | S | 2/2013 | Wong |
| 2002/0040909 | A1* | 4/2002 | Goto et al. ..... 220/709 |
| 2003/0034323 | A1 | 2/2003 | Smith et al. |
| 2003/0136783 | A1* | 7/2003 | Hatsumoto et al. ..... 220/254.3 |
| 2004/0217139 | A1 | 11/2004 | Roth |
| 2009/0255944 | A1 | 10/2009 | Yamashita et al. |
| 2010/0170902 | A1 | 7/2010 | Britto et al. |

FOREIGN PATENT DOCUMENTS

| | | | |
|---|---|---|---|
| CN | 201980547 | U | 9/2011 |
| CN | 201210512207-8 | | 9/2014 |
| DE | 4117220 | | 5/1992 |
| DE | 102006060143 | | 7/2008 |
| JP | 2000128218 | | 5/2000 |
| JP | 2003205958 | | 7/2003 |
| JP | 2007320618 | | 12/2007 |
| JP | 2011-57250 | A | 3/2011 |
| WO | 9624533 | | 8/1996 |
| WO | 2011030830 | | 3/2011 |

OTHER PUBLICATIONS

Zojirushi product—Stainless Steel Vacuum Bottle Model No. ST-KA12; Jun. 20, 2012.

Thermos catalog of Kids Lunch Kits and Food Storage, 2007, page showing Thermos FUNtainer bottle and lid, item 24227BA 006 and four photographs showing the FUNtainer lid.

U.S. Appl. No. 29/414,421 Office Action mailed Apr. 26, 2013 (10 pages).

Chinese patent application 201210512207.8 Office Action mailed Sep. 3, 2014 with translation (17 pages).

Korean patent application 10-2013-0022472 Notice of Allowance (1 page).

* cited by examiner

BEVERAGE CONTAINER SYSTEM WITH BUTTON RELEASE FOR LID

CROSS REFERENCE TO RELATED APPLICATION

This application is a continuation-in-part of prior application Ser. No. 13/407,238, filed Feb. 28, 2012.

FIELD OF THE INVENTION

The present invention relates generally to a beverage container system including a drink bottle and a removable lid, where the lid has an inner lid and a hinged outer lid openable upon pressing a button disposed near the hinge.

BACKGROUND

Personal beverage bottles are popular and have moved beyond the common beverage bottle packed with a school lunch or in a lunch box. Gyms are filled with members exercising, and many members bring their own beverage bottles for hydration. Hikers, bikers, walkers, commuters, tourists and many others carry beverage bottles as they go on their way. A common feature of the beverage lids is a drink opening that offers the ability to drink from the bottle without complete removal of the lid from the bottle. Another feature of some drink bottles is a cover for the drink opening to keep contaminants from entering the bottle.

SUMMARY

Certain embodiments of the present invention include a beverage bottle with a removable lid. The beverage bottle may include a lid engaging structure such as threads, snap-fit engagement, or any other lid engaging components known in the art. The lid may include a cooperating engaging structure configured to be compatible with the lid engaging structure on the bottle, such that the bottle and the lid can be easily, removably, and selectively secured to one another.

The lid may include an inner lid with a drink opening and an outer lid or cover that is hinged to selectively cover the drink opening. The outer lid may be locked to the inner lid when in the closed position. A push button on the inner lid can be operated to release the locked outer lid, permitting the outer lid to open so as to permit drinking from the drink opening. More specifically, a first end of the push button may be connected to a first end of a lid slide. The second end of the lid slide may extend into a portion on the inner lid opposite to the hinge and contain an extension that engages with a notch in the upper lid to hold the upper lid closed. The side of the push button positioned toward the center of the lid is mounted on a pivot connection. Accordingly, when one end of the push button is depressed towards the radial center of the lid, the other end of the push button moves away from the radial center of the lid and pulls the lid slide with it. The catch extension located on the other end of the lid slide moves out of engagement with the outer lid, thereby opening the outer lid.

In certain embodiments, a lid biasing element causes the outer lid to be moved into a fully open position—that is, the outer lid is open generally as far as the hinge permits—upon pressing the push button. The lid biasing element may be made of a flexible, resilient material that, it is deformable when the outer lid is in the closed position.

In certain other embodiments of the invention, the lid slide may be biased by a slide biasing element so that the extension that holds the outer lid in the closed position protrudes into its engagement position except when pressure is placed on the push button.

DETAILED DESCRIPTION OF CERTAIN EMBODIMENTS

Various embodiments will be described more fully with reference to the accompanying drawings, which form a part hereof, and which show, by way of illustration, certain embodiments. However, this invention may be embodied in many different forms and should not be construed as limited to the embodiments set forth herein. Rather, these embodiments are provided so that this disclosure will be thorough and complete, and will fully convey the scope of the invention to those skilled in the art. The following detailed description is not to be taken in a limiting sense.

Throughout the specification and claims, the following terms take the meanings explicitly associated herein, unless the context clearly dictates otherwise. The phrase "in one embodiment" does not necessarily refer to the same embodiment, although it may. Furthermore, the phrase "in another embodiment" does not necessarily refer to a different embodiment, although it may. Thus, as described below, various embodiments of the invention may be readily combined without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Figure 1:
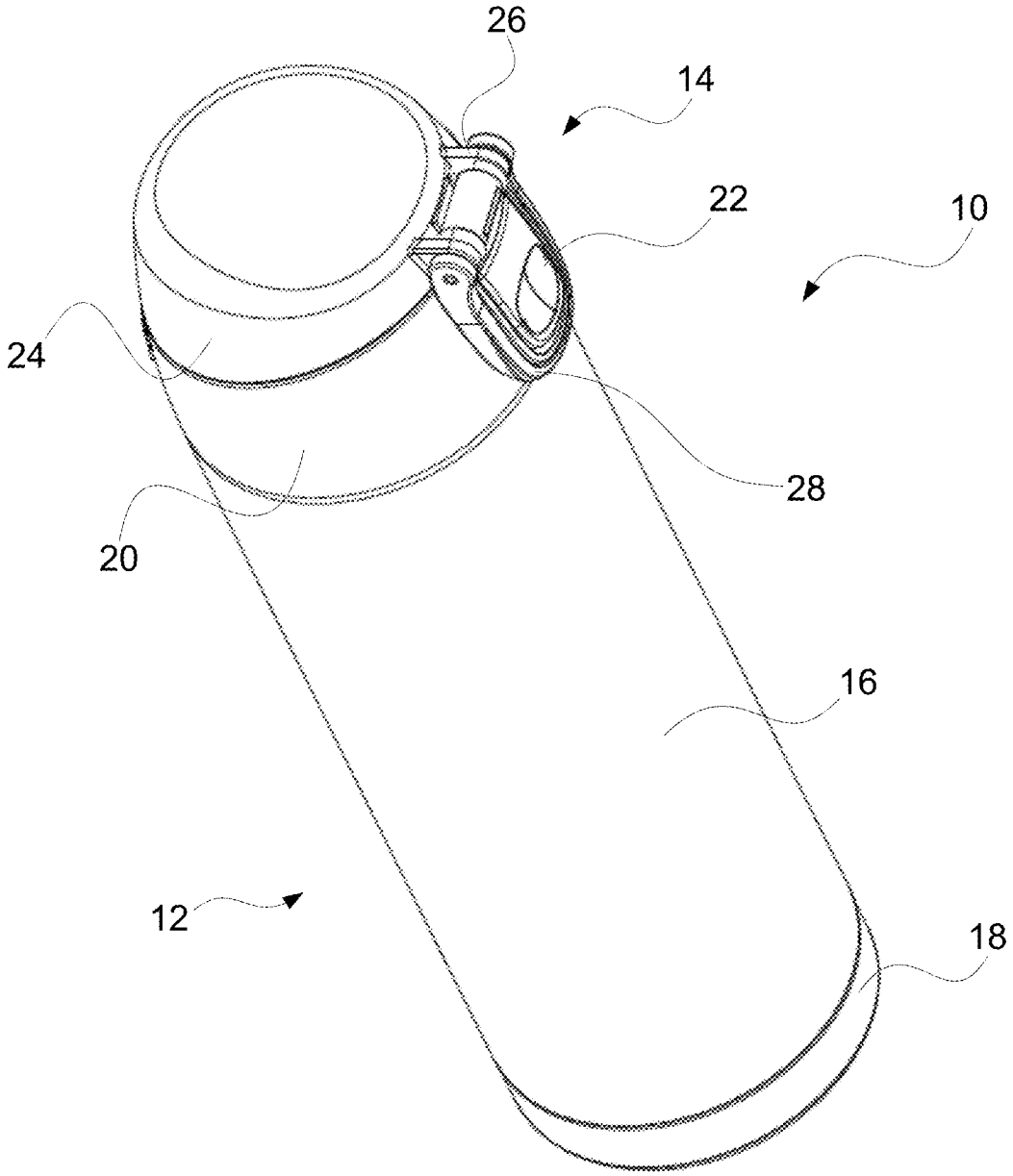
FIG. 1 is a top perspective view of an embodiment of a beverage container system of the present invention.

Referring first to FIG. 1, a beverage container system 10 includes a bottle body 12 and a removable lid 14. The bottle body 12 may be made of any suitable material, including metal, plastic, glass, rubber and combinations thereof and may be insulated or un-insulated. In the illustrated embodiment, the bottle body 12 is formed of an insulated stainless steel body part 16 on the bottom of which is fastened a plastic or rubber base 18. The bottle body 12 of one embodiment is of a double-walled construction between which is an evacuated space, forming a so-called vacuum bottle. The lid of the present invention may be used on a rigid bottle, as illustrated, or on a flexible bottle. The flexible bottle permits the user to squeeze the bottle to force the beverage from the bottle, while the rigid bottle requires the user to draw the liquid out of the bottle through suction or by pouring the liquid from the bottle. The base 18 of the bottle body 12 provides protection for the bottom of the bottle body as well as providing a relatively wide surface on which the bottle is rested when standing. The base is made of a plastic material, such as polypropylene, although other materials are of course possible. The bottle body 12 may have a smooth or contoured surface that may be provided with patterns, such as by printing, painting, embossing or otherwise.

The removable lid 14 may be removably secured to the mouth of the bottle 12 by a threaded connection in the illustrated embodiment. Threads are formed about the mouth of the bottle body 12 and cooperating threads are formed within the lid 14 so that the lid 14 may be threadably attached to and detached from the bottle body 12. The bottle body 12 may be a narrow-mouth bottle or a wide-mouth bottle; a wide-mouth bottle is shown. Other fastening means to attach the lid 14 to the bottle 12 may be provided instead, such as a snap-on lid that fits onto a rim on the bottle, a bayonet attachment, or other lid attachment structure.

The removable lid 14 has an inner lid 20, a push button 22, an outer lid 24, and a hinge 26 that connects the inner lid 20 to the outer lid 24. The hinge 26 may include an outer lid hinge element 64 and an inner lid hinge element 66. A handle 28 may be attached to the inner lid 20 and/or the outer lid 24 to provide a convenient method of carrying the beverage container system 10 or attaching the beverage container system 10 to a backpack, gym bag or the like.

The outer lid 24 may be in a closed position or an open position. In the closed position, as shown in FIG. 1, outer lid 24 covers the top of the inner lid 20. The outer lid 24 is movable to the open position after a user releases the locking mechanism by pressing the push button 22.

Figure 2:
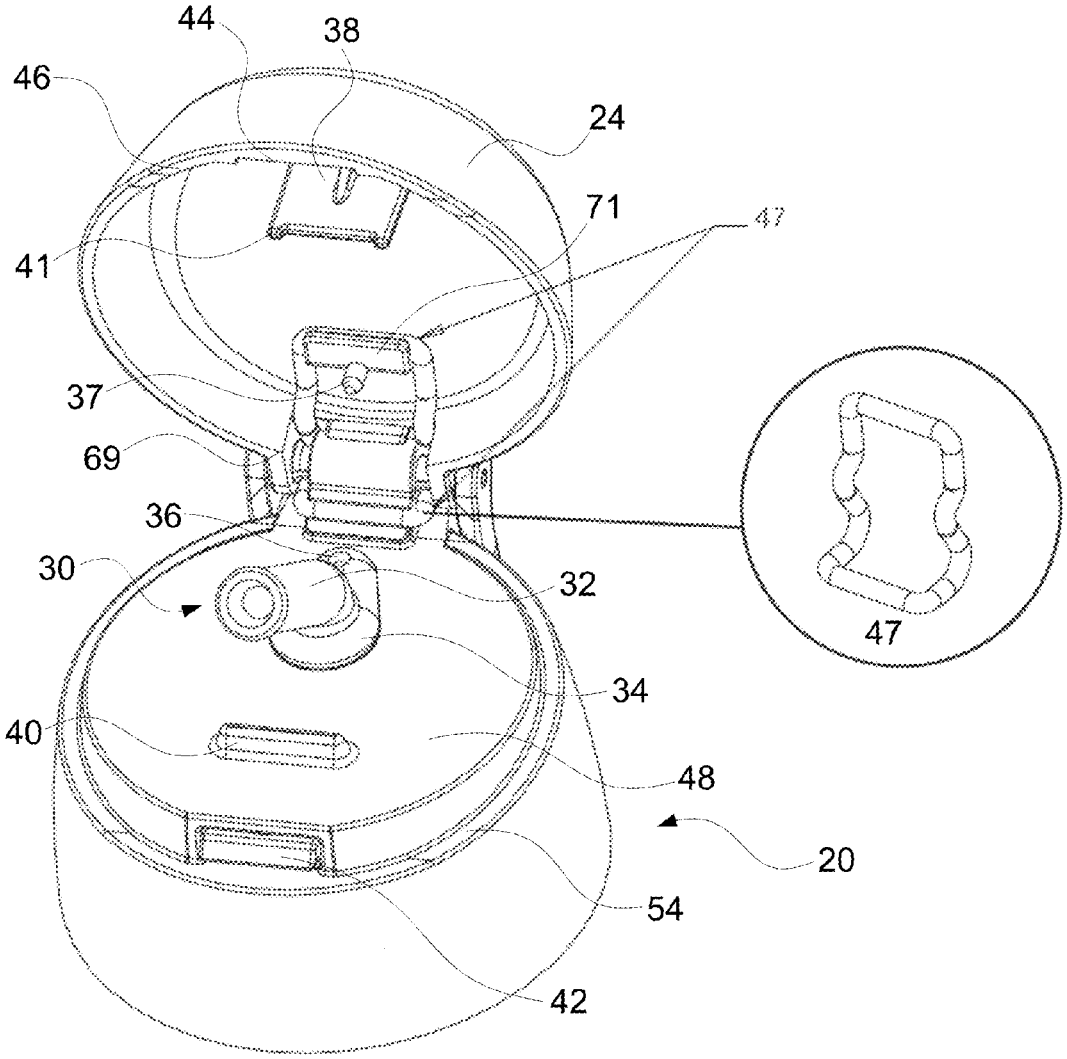
FIG. 2 is a top perspective view of an embodiment of the removable lid of the present invention and includes a separate view of an embodiment of a lid biasing element.

The removable lid 14 is shown in the open position in FIG. 2. The open position provides access to the drink apparatus 30. A drink apparatus 30 may be configured as a drink nozzle, a drink spout, a drink straw, drinking tube, pour spout, a general drink aperture, an aperture configured to receive a drink spout, drink straw, or drinking tube, or otherwise configured to permit a person to consume a liquid therethrough. The drink apparatus 30 shown in FIG. 2 includes a drinking tube 32 that extends through the inner lid 20 which is then connected to an internal straw (not shown) and into the interior of bottle body 12. The user may drink from the bottle while keeping the bottle upright by sipping from the drinking tube 32. The straw preferably extends to the bottom of the body bottle 12 and may extend coaxially within the bottle or extend at an angle to a lower corner of the bottle, for example.

The drinking tube 32 is mounted through a pedestal 34. The pedestal 34 provides structural support for drinking tube 32 and helps to keep drinking tube 32 oriented in a direction away from the hinge 26 and open outer lid 24 to minimize the extent the outer lid 24 interferes with the user's face as he or she is drinking. Pedestal 34 may contain vent hole 36 that provides a passageway to the interior of body bottle 12. When a user drinks, the liquid in body bottle 12 is drawn through the internal straw and out from drinking tube 32. The removal of liquid from the bottle may cause a negative air pressure within the bottle, especially for rigid bottle configurations. By providing vent hole 36, the negative pressure within body bottle 12 is prevented by the inflow of air into the bottle through the vent, thereby making drinking from the bottle easier. The vent hole 36 in the pedestal 34 is closed by a vent pin 37 that extends from the interior of the outer lid 24. Closing of the vent hole 36 when the lid is closed helps prevent leaking of the liquid from the drink bottle, for example, when the bottle is stored on its side such as when placed into a school locker or gym bag. When the outer lid 24 is opened, the vent pin 37 moves clear of the vent hole 36, permitting the flow of air into the interior of the bottle body 12 when a user drinks from the drinking tube 32. If the present lid is to be used on a flexible squeeze bottle in which the user squeezes the bottle to force the beverage from the drink apparatus, the vent hole and the vent closing pin may not be necessary.

The drinking tube 32 may be formed of a pliable material, such as silicon rubber that flexes and bends readily. When the outer lid 24 is moved to the closed position, a bending flange 38 extending from the inner surface of the outer lid presses on the drinking tube 32 and bends it down from the upwardly angled position shown in FIG. 2. The downwardly flexed tube 32 presses against a drinking tube counter ridge 40 on the inner lid 20. The counter ridge 40 is mounted on the top surface of inner lid 20. The combined effect of the bending flange 38 and the counter ridge 40 is to pinch the tube 32 so as to close the tube and prevent leakage of fluid from the beverage container system 10 when the outer lid 24 is closed. The bending flange 38 on the inside of the outer lid 24 may have projections 41 on either side to keep the drinking tube 32 from slipping to the left or right of the flange 38 when closing the outer lid 24.

Outer lid 24 is kept in the closed position over inner lid 20 by the engagement of a catch extension 42 with catch notch 44 located on circumferential lower edge 46 of outer lid 24. The catch extension 42 may protrude from a catch extension opening at or near a front of inner lid 20. The catch extension 42 may be moved out of engagement with the catch notch 44 by actuating push button 20. After catch extension 42 is disengaged from catch notch 44, in one embodiment, outer lid 24 is biased into the fully open position at least in part by lid biasing element. The details of the lid biasing mechanism and lid release mechanism are described in more detail below.

Figure 3:
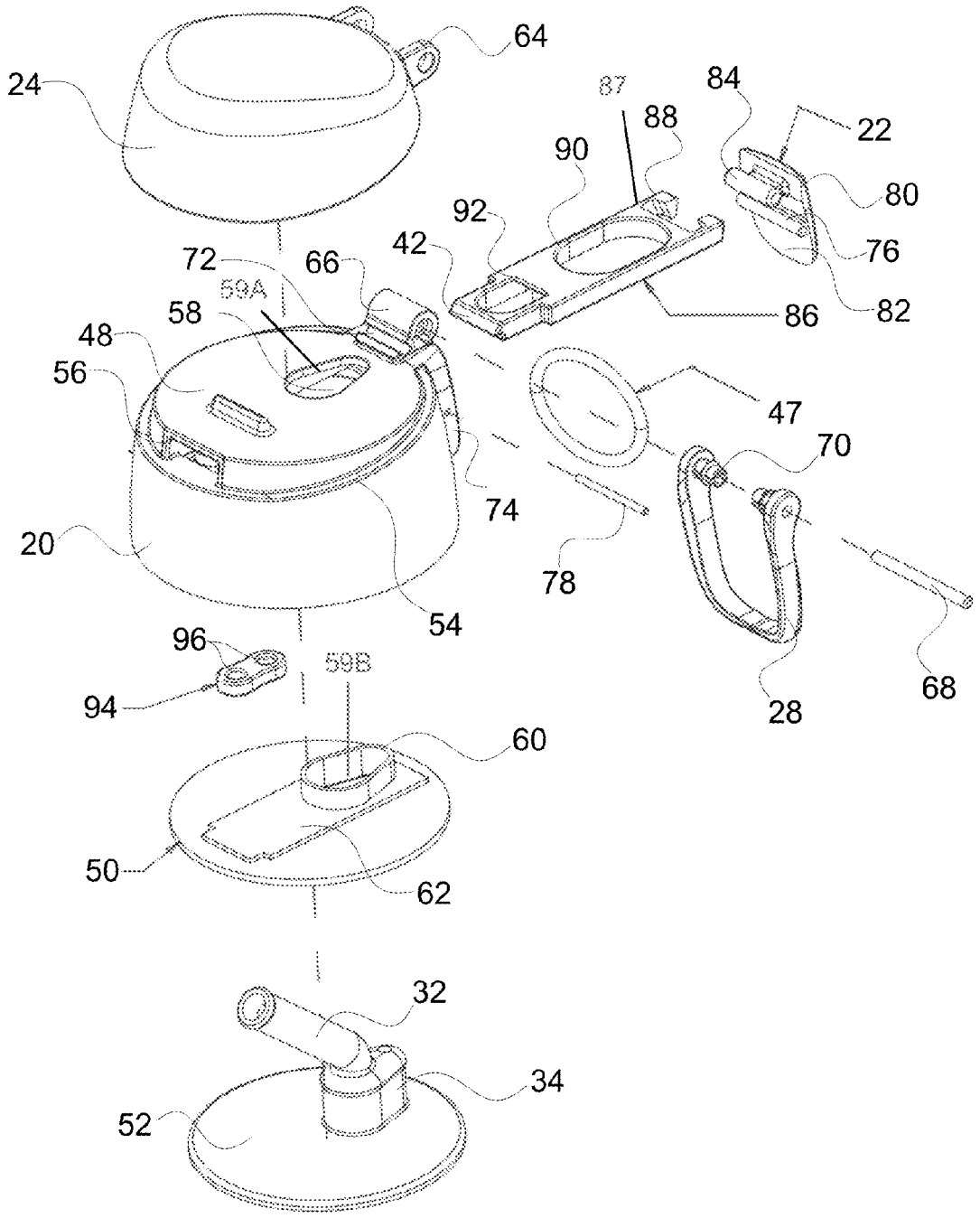
FIG. 3 is an exploded view of an embodiment of a removable lid of the present invention.
Figure 4:
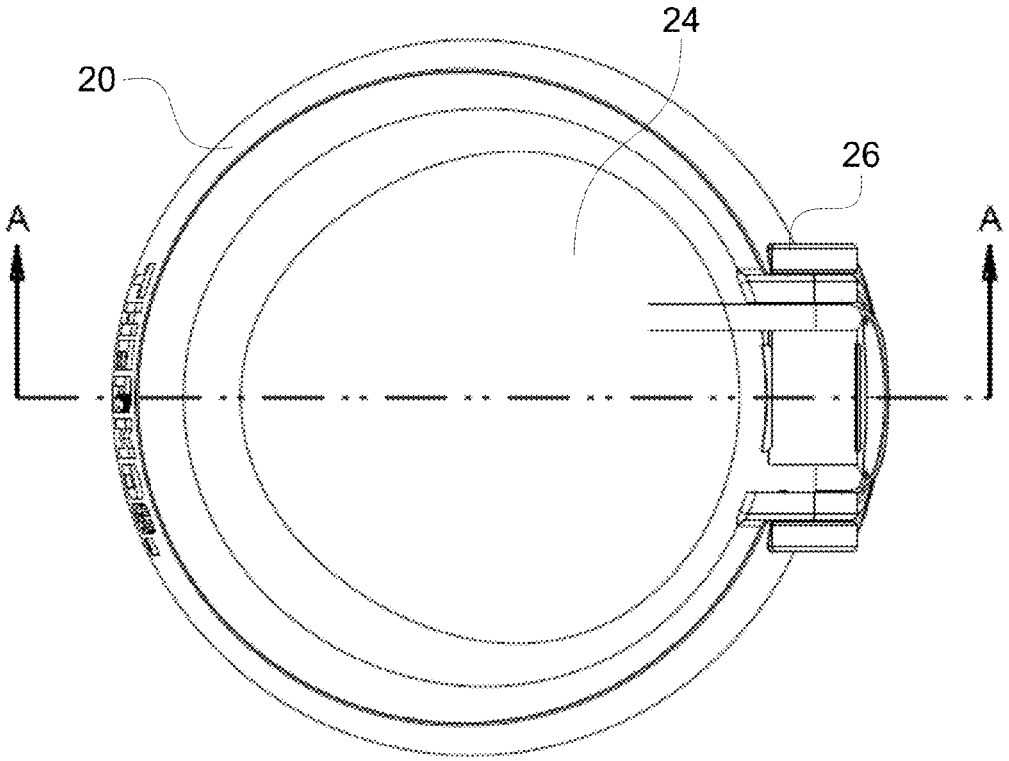
FIG. 4 is a top view of the embodiment of a removable lid of the present invention illustrated in FIG. 4 and includes line A-A along which the cross section of FIG. 5 is taken.

As shown in FIG. 3, an inner lid 20 may be comprised of an upper cover 48, a middle cover 50, and a lower cover 52. An upper cover 48 may take many different configurations. In certain embodiments, an upper cover 48 contains a tube aperture 58 defined by an aperture edge 59. In other embodiments, the upper cover 48 includes an upper aperture edge 59A and the middle cover 50 includes a middle aperture edge 59B. Either aperture edge 59 may be extended generally upward to form a tube aperture extension 60, which may be configured to receive a pedestal 34 or other portion of the drinking apparatus 30.

The upper cover 48 also may include has an upper section with a decreased diameter so that an outer lid receiving ridge 54 is formed around all or part of the circumference of upper cover 48. The circumferential lower edge of outer lid 24 meets with the outer lid receiving ridge 54 to shield the upper portion of a removable lid 14 from dirt and contamination and enclose the tube 32 within its interior.

A catch extension opening 56 is configured to permit the catch extension to pass at least partially therethrough. The catch extension opening 56 may be formed in the face of upper cover 48 perpendicular to ridge 54. The catch extension 42 extends through catch extension opening 56, except when push button 22 is actuated thereby causing catch extension 42 to be pulled out of the catch extension opening 56 and pulled into the interior space between upper cover 48 and middle cover 50.

A middle cover 50 is sized with a diameter such that when middle cover 50 is inserted into upper cover 48 during manufacturing, the peripheral upper edge of middle cover 50 contacts the internal lower edge of ridge 54 to form a compartment between upper cover 48 and middle cover 50 that has catch extension opening 56 on one side and a push button opening (not shown in this view) directly opposite.

A lower cover 52 may have the same diameter as middle cover 50 or a different diameter. A pedestal 34 extends upward from the top of lower cover 52, and a drinking tube 32 extends from pedestal 34.

On assembly, drinking tube 32 and at least part of the pedestal 34 are inserted through a tube aperture 58 and upper cover 48. The middle cover 50 and lower cover 52 are then connected together to form middle-lower lid. The covers may be attached together in any known manner. Seals may be used to prevent liquids from passing between the covers that form the middle-lower lid. In an alternate embodiment, inner lid 20 may be formed from only two covers. In such an alternate embodiment, the middle cover 50 and lower cover 52 may be combined into one structure.

In certain embodiments, when the outer lid 24 is released from inner lid 20 by the actuation of push button 22 thereby causing disengagement of catch extension 42 from catch notch 44, outer lid 24 moves toward an open position in part by the biasing force of a tube 32 acting on bending flange 38 as will be discussed below. Outer lid 24 is also moved toward a fully open position and may be automatically held in the fully open position by a lid biasing mechanism. An embodiment of a lid biasing element 47, shown in FIG. 2 in its assembled configuration and in FIG. 3 in its free state, is a silicone O-ring that extends between inner lid 20 and outer lid 24. More particularly, lid biasing element 47 is inserted into a biasing element slot 72 either attached to or formed near the peripheral upper edge of the upper cover 48, generally adjacent to the hinge 26. In one embodiment, biasing element slot 72 is formed integrally with inner lid hinge element 66. The lid biasing element 47 then passes behind each end of the lid pin 68, through outer lid slots 69 and around a lid biasing element receiver 71 located on an interior surface of outer lid 24. In its free state, lid biasing element 47 takes the shape of an O-ring and is made of a flexible material that is resilient and biases outer lid toward the fully open position by exerting tension forces thereon. When outer lid 24 is in the closed position, the lid biasing element 47 is bent almost 180 degrees back on itself when it extends from biasing element slot 72, around the ends of the lid pin 68 to connect with lid biasing element receiver 71. Since the lid biasing element 47 is stretched, it exerts tension forces to cause outer lid 24 to move toward the open position and to be retained there when the outer lid is open. A lid biasing element 47 may be made of other materials and have other configurations.

In addition to the force exerted by lid biasing element 47, the drinking tube 32 is in the crimped position as a result of being pressed by the bending flange 38 and against the counter ridge 72 when the outer lid 24 is in the closed position. The resilient nature of the drinking tube 32 and the material of which it is formed biases the outer lid 24 toward the open position as a result of the bending flange 38 pressing on the tube material. As a result, the tube provides a primary force for initial opening the outer lid 24 upon actuation of the release button 22. Further opening force to the fully open position is provided by the biasing element 47. The biasing element 47 may provide a primary force for moving outer lid 24 to the fully open position or the lid may be moved toward the fully open position by the user and retained there by the lid biasing element 47. The force of the lid biasing element 47 on the outer lid 24 is easily overcome by the user to move the outer lid 24 to the closed position.

The outer lid release mechanism is comprised of a push button 22, a lid slide 86, and a slide biasing element 94. In certain embodiments, a push button 22 has a pivotal connection element 76 that holds it within push frame 74 by a push button pin 78. The pivotal connection element 76 sections the push button 22 into a first button area and a second button area, thereby allowing a rocking movement around the pivotal connection. In certain embodiments, the first button area and second button area are an upper button area 80 and a lower button area 82, respectively. Slide engagement extension 84 extends from an inner surface of the upper button area 80 and engages with a button engagement extension 88 near a first slide end 87 of the lid slide 86. A second slide end 89 of the lid slide 86 contains catch extension 42 that protrudes from a catch extension opening 56 in the upper cover 48.

Figure 5:
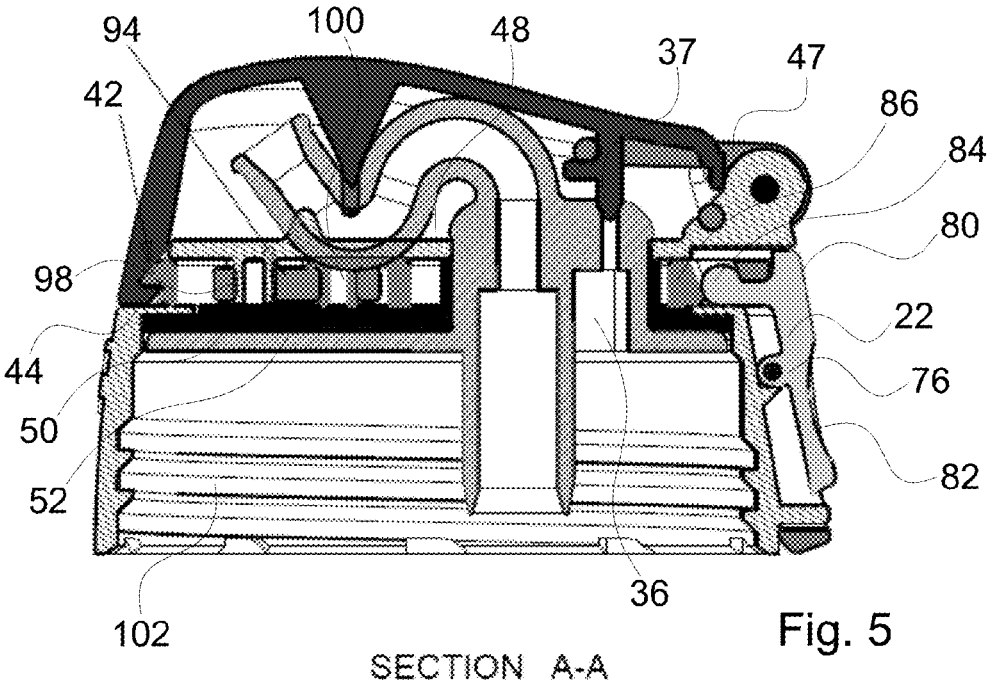
FIG. 5 is a side cross-sectional view of the embodiment of a removable lid in a closed position taken along the section line A-A as shown in FIG. 4.
Figure 6:
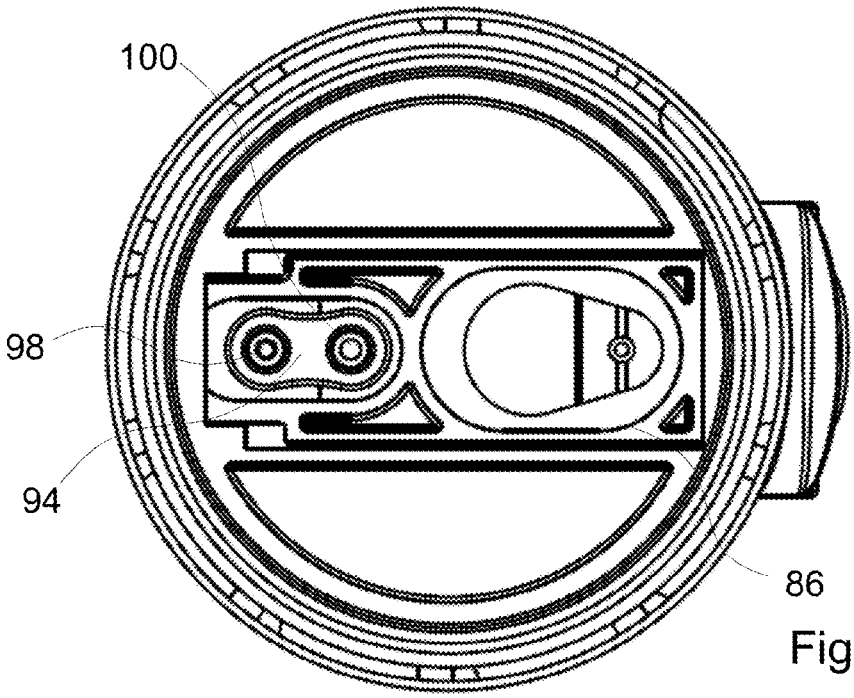
FIG. 6 is a top cross-sectional view of the removable lid illustrated in FIG. 5 in the closed position.

The lid slide 86 may be located within the interior space between upper cover 48 and middle cover 50. As shown in FIG. 5, lid slide 86 contains a slide bias support 100, which extends generally perpendicularly to the length of lid slide 86. The cover bias support 98 extends from the upper cover 48 but may also extend from middle inner cover 50. Slide bias support 100 and cover bias support 98 extend through support receiving holes 96 in slide biasing element 94. Slide biasing element 94 may be made of a resilient material such as silicone that tends to keep its shape, or may be made of a spring-like material that has the property of biasing towards its original shape. Slide bias support 100, cover bias support 98 and slide biasing element 94 are positioned such that catch extension 42 of lid slide 86 extends from catch extension opening 56 when slide biasing element is in its relaxed state, as shown in FIGS. 5 and 6.

Figure 7:
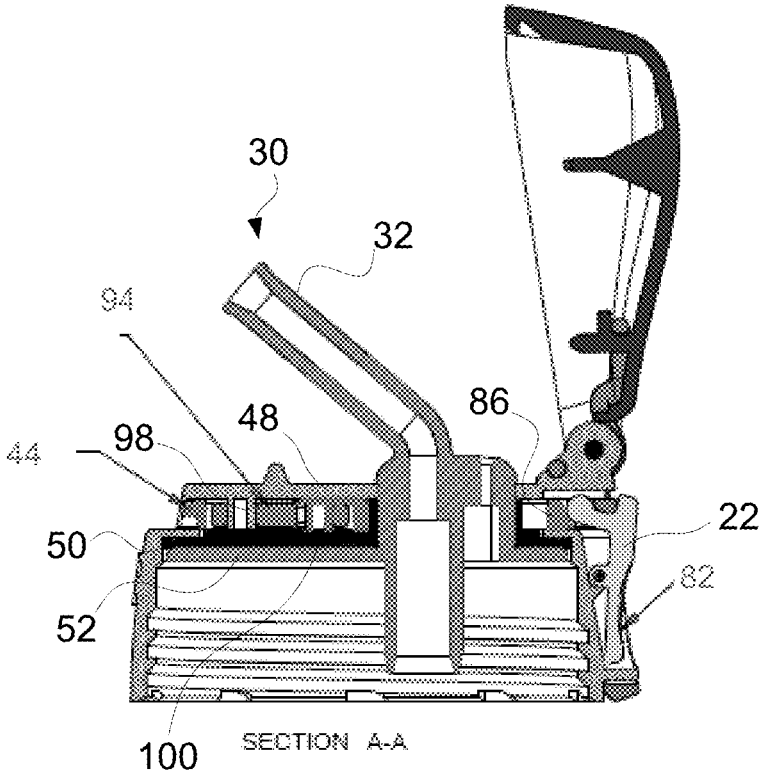
FIG. 7 is a side cross-sectional view of the removable lid in the open position taken along the same section line A-A as shown in FIG. 4.
Figure 8:
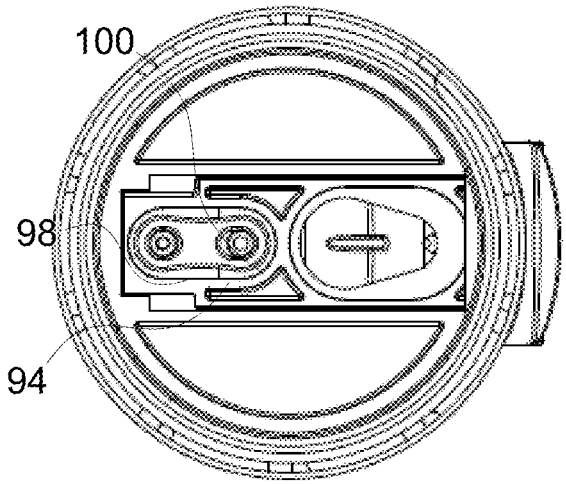
FIG. 8 is a top cross-sectional view of the removable lid in the closed position.

On pushing an exterior-facing surface of the lower button area 82 of push button 22 towards the radial center of removable lid 14, the upper button area 80 moves radially outward. This motion pulls lid slide 86 in the direction towards a side of the lid with the push button 22 and causes catch extension 42 to be retracted into catch extension opening 56. Retracting catch extension 42 causes it to disengage from catch notch 44 of outer lid 24 thereby releasing outer lid 24 from the closed and latched position so that it may move into the open position. The retracted position of lid slide 86 with outer lid 24 in the open position is shown in FIGS. 7 and 8. As apparent in FIG. 8, slide biasing element 94 is in an extended state because it is being stretched between cover bias support 98 and slide bias support 100, and exerts a force, which brings them towards each other.

On releasing the push button 22, the slide biasing element 94 retracts from its stretched condition to cause lid slide 86 to move away from the side of the lid with the push button 22 and back into its original position. Thus, the catch extension 42 can be moved out of engagement with catch notch 44, but is biased back into its original position through slide biasing element 94. In another embodiment, slide biasing element 94 may be connected between push button 22 and inner lid 20 within the push frame 74. In such an embodiment, the biasing may be either through, for example, the expansion or compression of a spring or other resilient material.

To keep lid slide 86 in its proper position, middle inner cover 50 may contain frame 62 that provides a guide for the lower sides of lid slide 86. Lid slide 86 may also contain a tube clearance opening 90 to provide space for the tube aperture extension 60 and allow passage of drinking tube 32 from the interior of the bottle through inner lid cover 20. While the illustrated embodiment shows a notch in the outer lid and an extension on the end of the lid slide, alternative embodiments may be used such reversing the locations of the notch and extension or use of other mechanical or magnetic locking mechanisms.

The outer lid 24 and inner lid 20 are of polypropylene in certain embodiments, but may be made of any number of plastics such as PET, HDPE, LDPE or other polyesters. The push button 22 may be of polypropylene or another material. As noted above, the drinking tube 32 and spring 96 may be made of silicone rubber. Other materials are of course possible and are encompassed within the scope of the present invention.

Thus, there has been shown and described a drink bottle having a removable lid that has a drinking tube and a lockable cover or outer lid over the drinking tube. Although other modifications and changes may be suggested by those skilled in the art, it is the intention of the inventor to embody within the patent warranted hereon all changes and modifications as reasonably and properly come within the scope of his contribution to the art.

I claim:

1. A beverage container system, comprising:

an inner lid including:

a drink apparatus, and an inner lid hinge element;

an outer lid including:

a catch notch configured to receive a catch extension, and an outer lid hinge element for pivoting engagement with the inner lid hinge element such that the outer lid is pivotable relative to the inner lid between an open position and a closed position;

a push button having a pivotal connection element such that actuating a first button area of the push button radially inward towards a generally central portion of the lid causes a second button area of the push button to move radially away from the generally central area of the lid;

a lid slide moveable between an outer lid-locking position and an outer lid-releasing position, the lid slide having a first slide end connected to the first area of the push button through a push button opening and a second slide end having a catch extension for engagement with the catch notch of the outer lid; and a slide biasing element connected to the lid slide and to the inner lid to bias the lid slide into the lid-locking position, wherein actuating the push button causes the lid slide to move to the lid-releasing position in opposition to a biasing action when the push button is not being actuated.

2. The beverage container system as claimed in claim 1, wherein the drink apparatus includes:

a drink aperture configured as a tube aperture;

a drinking tube configured to be mounted in the tube aperture of the inner lid, wherein the inner lid and the outer lid together generally enclose the drinking tube when the outer lid is in the closed position.

3. The beverage container system as claimed in claim 2, the drink apparatus further includes a drink straw, which together with the drinking tube is configured to permit a user to drink fluid stored below the lid when the outer lid is in the open position.

4. The beverage container system as claimed in claim 2, wherein the lid slide includes a tube clearance opening configured to permit at least the drinking tube to pass therethrough.

5. The beverage container system as claimed in claim 2, wherein the drink apparatus further includes a pedestal configured to support the drinking tube.

6. The beverage container system as claimed in claim 4, wherein:

the pedestal includes a vent hole, and the outer lid includes a vent pin disposed to generally cover the vent hole when the outer lid is in the closed position.

7. The beverage container system as claimed in claim 4, wherein the inner lid includes an upper cover, a middle cover, and a lower cover, and wherein the middle cover has a middle aperture edge generally extended upward to form a tube aperture extension configured to receive the pedestal.

8. The beverage container system as claimed in claim 1, wherein the slide biasing element is a silicone spring configured to stretch when the lid slide is moved from the lid-locking position to the lid-releasing position.

9. The beverage container system as claimed in claim 1 further comprising a lid biasing element coupled between the inner lid and the outer lid to bias the outer lid into the open position.

10. The beverage container system as claimed in claim 1-9, wherein the lid biasing element is an O-ring.

11. The beverage container system as claimed in claim 1 further comprising a bottle having a lid engaging structure and wherein the inner lid has a cooperating engaging structure configured to permit selectively securing the lid to the bottle.

12. The beverage container system as claimed in claim 1 further comprising a handle coupled to the inner lid.

13. The beverage container system as claimed in claim 1 further comprising:

a bending flange on an inner surface of the outer lid; and a counter ridge on a top surface of the inner lid, wherein when the outer lid is in the closed position, the bending flange and the center ridge cooperate to substantially seal the drinking tube.

14. The beverage container system as claimed in claim 1, wherein the inner lid includes an upper cover and a lower cover, which when attached together generally block any liquid from passing therethrough except through the drink apparatus.

15. The beverage container system as claimed in claim 1, wherein the inner lid includes an upper cover, a middle cover, and a lower cover, which when collectively attached together generally block any liquid from passing entirely therethrough except through the drink apparatus.

16. The beverage container system as claimed in claim 15, wherein the upper cover includes a catch extension opening configured to permit a catch extension to pass at least partially threrethrough.

17. The beverage container system as claimed in claim 15, wherein the upper cover includes an outer lid receiving ridge configured to receive the outer lid when the outer lid is in the closed position.

18. The beverage container system as claimed in claim 1, wherein the outer lid includes a lid biasing element receiver, and wherein the outer lid and the inner lid hinge element form an outer lid slot on each side of the inner lid hinge element.

19. A lid for a beverage container system, comprising:

an inner lid including:

a drink apparatus, and an inner lid hinge element;

an outer lid including:

a catch notch configured to receive a catch extension, and an outer lid hinge element for pivoting engagement with the inner lid hinge element such that the outer lid is pivotable relative to the inner lid between an open position and a closed position;

a push button having a pivotal connection element such that actuating a first button area of the push button radially inward towards a generally central portion of the lid causes a second button area of the push button to move radially away from the generally central area of the lid;

a lid slide moveable between an outer lid-locking position and an outer lid-releasing position, the lid slide having a first slide end connected to the first area of the push button through a push button opening and a second slide end having a catch extension for engagement with the catch notch of the outer lid; and a slide biasing element connected to the lid slide and to the inner lid to bias the lid slide into the lid-locking position, wherein actuating the push button causes the lid slide to move to the lid-releasing position in opposition to a biasing action when the push button is not being actuated.

20. The lid for a beverage container system as claimed in claim 19, wherein the push button is generally disposed near where the inner lid hinge element and outer lid hinge element meet to form the pivoting engagement.

* * * * *